US006438336B1

(12) United States Patent
Bengtson

(10) Patent No.: US 6,438,336 B1
(45) Date of Patent: Aug. 20, 2002

(54) METHOD AND APPARATUS FOR VARYING GLOSS LEVEL FOR INDIVIDUAL ELEMENTS PRINTED ON A SINGLE PAGE

(75) Inventor: Kurt R. Bengtson, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/776,055

(22) Filed: Feb. 2, 2001

(51) Int. Cl.[7] ..... G03G 15/20
(52) U.S. Cl. ..... 399/67; 399/322; 399/341
(58) Field of Search ..... 399/67, 85, 194, 399/322, 341

(56) References Cited

U.S. PATENT DOCUMENTS 4,791,447 A * 12/1988 Jacobs ..... 399/328 X
5,019,869 A * 5/1991 Patton ..... 399/320
5,493,378 A * 2/1996 Jamadeh et al. ..... 399/67 X
5,666,592 A * 9/1997 Aslam et al. ..... 399/67
5,678,133 A * 10/1997 Siegel ..... 399/67
6,078,760 A * 6/2000 Abe et al. ..... 399/322 X
6,101,345 A 8/2000 Van Goethem et al. ..... 399/69
6,271,870 B1 * 8/2001 Jacob et al. ..... 399/67 X

* cited by examiner

*Primary Examiner*—Fred L. Braun

(57) ABSTRACT

A method and apparatus are presented in which gloss level is varied between individual elements printed on a single media sheet. The sheet of media is fed into a print engine with a first side of the sheet of media in position to be printed upon. A first element on the first side of the sheet of media is printed with a first gloss level finish. The sheet of media is circulated in a duplex media path so that the sheet of media is again fed into the print engine but with a second side of the sheet of media in position to be printed upon. The sheet of media is again circulated in the duplex media path so that the sheet of media is fed into the print engine with the first side of the sheet of media in position to be printed upon. A second element is printed on the first side of the sheet of media with a second gloss level finish.

13 Claims, 5 Drawing Sheets

31
35
37
36
38
34
DRIVER
39
COMPUTER
RENDERED PAGE
TAGS FOR GLOSS LEVEL
32
40
41
PRINTER FIRMWARE
33
PRINTER ENGINE
PRINT GLOSSY ELEMENTS
FUSE
PAGE RETURN (DUPLEXER)
FUSE
PAGE RETURN (DUPLEXER)
42
43
44
45
46
FUSING ITERATIONS COMPLETED?
NO
YES
47
PRINT MATTE ELEMENTS
FUSE
DONE
48
49
50

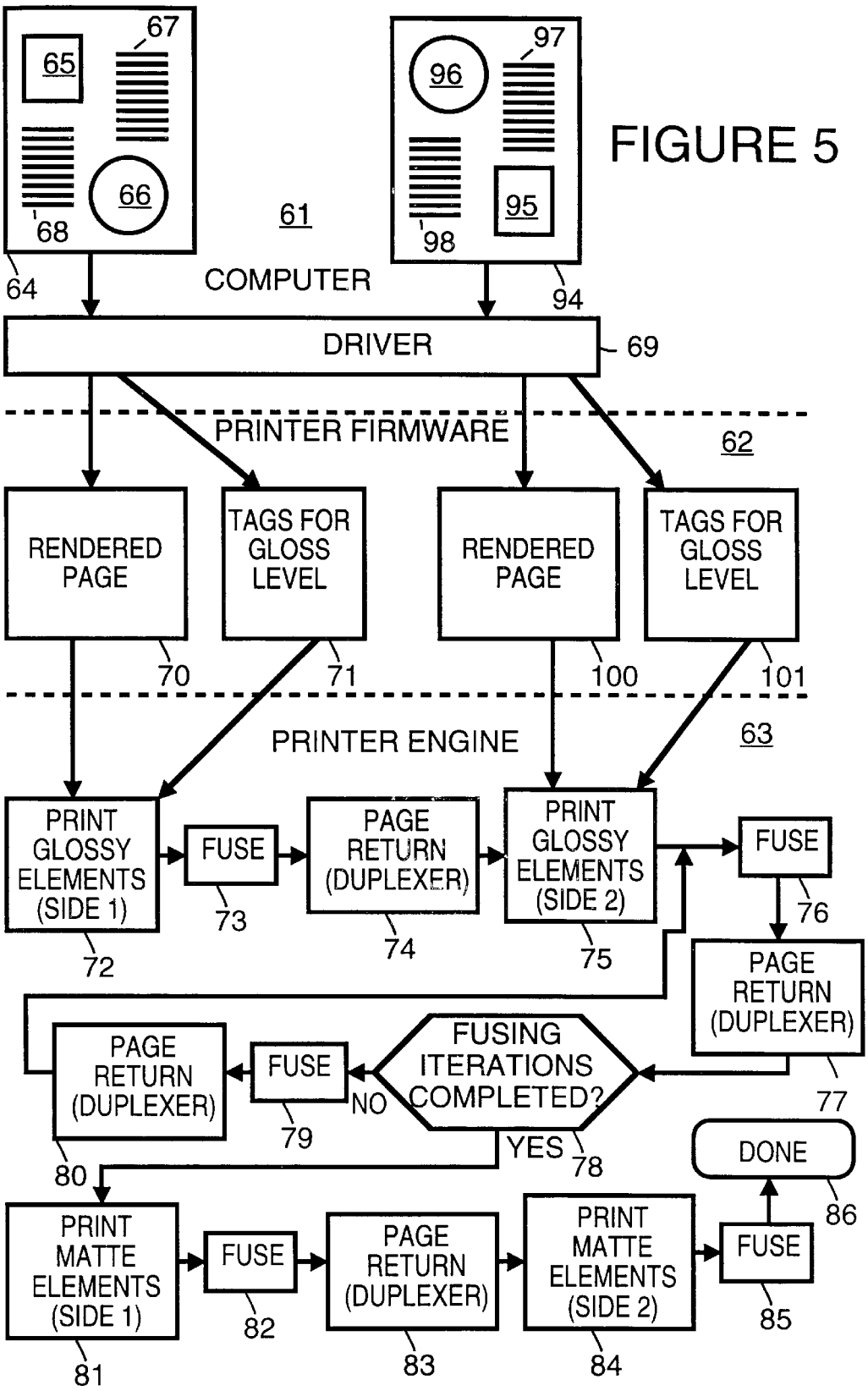
FIGURE 5
61
COMPUTER
64
65
66
67
68
94
95
96
97
98
DRIVER
69
PRINTER FIRMWARE
62
RENDERED PAGE
TAGS FOR GLOSS LEVEL
RENDERED PAGE
TAGS FOR GLOSS LEVEL
70
71
100
101
PRINTER ENGINE
63
PRINT GLOSSY ELEMENTS (SIDE 1)
FUSE
PAGE RETURN (DUPLEXER)
PRINT GLOSSY ELEMENTS (SIDE 2)
FUSE
72
73
74
75
76
PAGE RETURN (DUPLEXER)
77
FUSING ITERATIONS COMPLETED?
NO
YES
78
FUSE
79
PAGE RETURN (DUPLEXER)
80
DONE
86
PRINT MATTE ELEMENTS (SIDE 1)
FUSE
PAGE RETURN (DUPLEXER)
PRINT MATTE ELEMENTS (SIDE 2)
FUSE
81
82
83
84
85

METHOD AND APPARATUS FOR VARYING GLOSS LEVEL FOR INDIVIDUAL ELEMENTS PRINTED ON A SINGLE PAGE

BACKGROUND OF THE INVENTION

The present invention concerns printing systems and pertains particularly to varying the gloss level of individual elements printed on a single page.

Color electro-photographic (EP) print systems produce a wide range of gloss level ranging from very matte to very glossy. A glossy-finish is specifically defined herein as a print media finish that provides a surface brightness or shine when illuminated by a light source. A matte-finish is specifically defined herein as a print media finish that lacks surface brightness or shine when illuminated by a light source. Glossy-finish and matte-finish have various characteristics that are desired for various printing applications. People express very strong preferences for gloss level depending on the content of a document. For instance, people prefer glossy images but do not like reading glossy text.

Generally, many printers allow a user to select a glossy-finish or a matte-finish. While selection of media can strongly influence the resulting level of brightness/shine of the finish, some printers allow a user to vary the brightness/shine of the finish without switching media type. For example, in some electro-photographic print systems, gloss level can be varied by adjusting fusing settings, such as fusion temperature and/or fusion duration. See U.S. Pat. No. 6,101,345 issued to Luc Van Goethem, et al. for METHOD FOR GLOSS CONTROL IN AN ELECTROGRAPHIC APPARATUS. Generally, with the exception of very expensive high-end printers, it is not possible to vary gloss level for individual items or areas on a page. In high end printers that allow variable gloss levels on a single page, a special print stage is added to increase the gloss of individual elements on the page. This is an expensive solution that is not practical for low cost color printers.

One low cost solution for an owner of a color printer is to manually create a composite page and print the different elements separately by repeatedly passing the page through the printer by hand. This method, however, is cumbersome and inefficient.

SUMMARY OF THE INVENTION

In accordance with the preferred embodiments of the present invention, gloss level is varied between individual elements printed on a single sheet of media. The sheet of media is fed into a print engine with a first side of the sheet of media in position to be printed upon. A first element on the first side of the sheet of media is printed with a first gloss level finish. The sheet of media is circulated in a duplex media path so that the sheet of media is again fed into the print engine but with a second side of the sheet of media in position to be printed upon. The sheet of media is again circulated in the duplex media path so that the sheet of media is fed into the print engine with the first side of the sheet of media in position to be printed upon. A second element is printed on the first side of the sheet of media with a second gloss level finish.

For example, the first gloss level finish is a higher gloss finish than the second gloss level finish (e.g., glossy finish verses matte finish).

When a fuser is used to vary the gloss level, upon printing the first element, toner is placed on the first side of the sheet of media. The first side of the sheet of media is fused at a setting corresponding to the first gloss level finish. When printing the second element, toner is again placed on the first side of the sheet of media. The first side of the sheet of media is fused at a setting corresponding to the second gloss level finish.

The present invention also can be used when printing on both sides of a media sheet. For example, after the sheet of media is fed into the print engine with the second side of the sheet of media in position to be printed upon, a third element can be printed on the second side of the sheet of media with the first gloss level finish. After printing the second element on the first side of the sheet of media, the sheet of media can again be circulated in the duplex media path so that the sheet of media is again fed into the print engine with the second side of the sheet of media in position to be printed upon. A fourth element can then be printed on the second side of the sheet of media with the second gloss level finish.

In the preferred embodiment, when rendering a page image that includes the first element and the second element, the first element is identified as having the first gloss level finish. The second element is identified as having the second gloss level finish.

The present invention allows for varying the gloss level finish of individual elements on a page without the requirement of sophisticated printer computation and without requiring the addition of special fusing hardware or other print stage hardware.

BRIEF DESCRIPTION OF THE DRAWINGS

FIG. 5 is a flow chart for a print job in which there are differing gloss levels for individual elements on a double-sided page in accordance with a preferred embodiment of the present invention.

DESCRIPTION OF THE PREFERRED EMBODIMENT

The present invention allows selectively increasing the gloss level of specified elements on a page using any printing device that has a duplexer. The invention is particularly useful for a printing device that uses a fuser, or similar device, to control the level of gloss.

Figure 1:
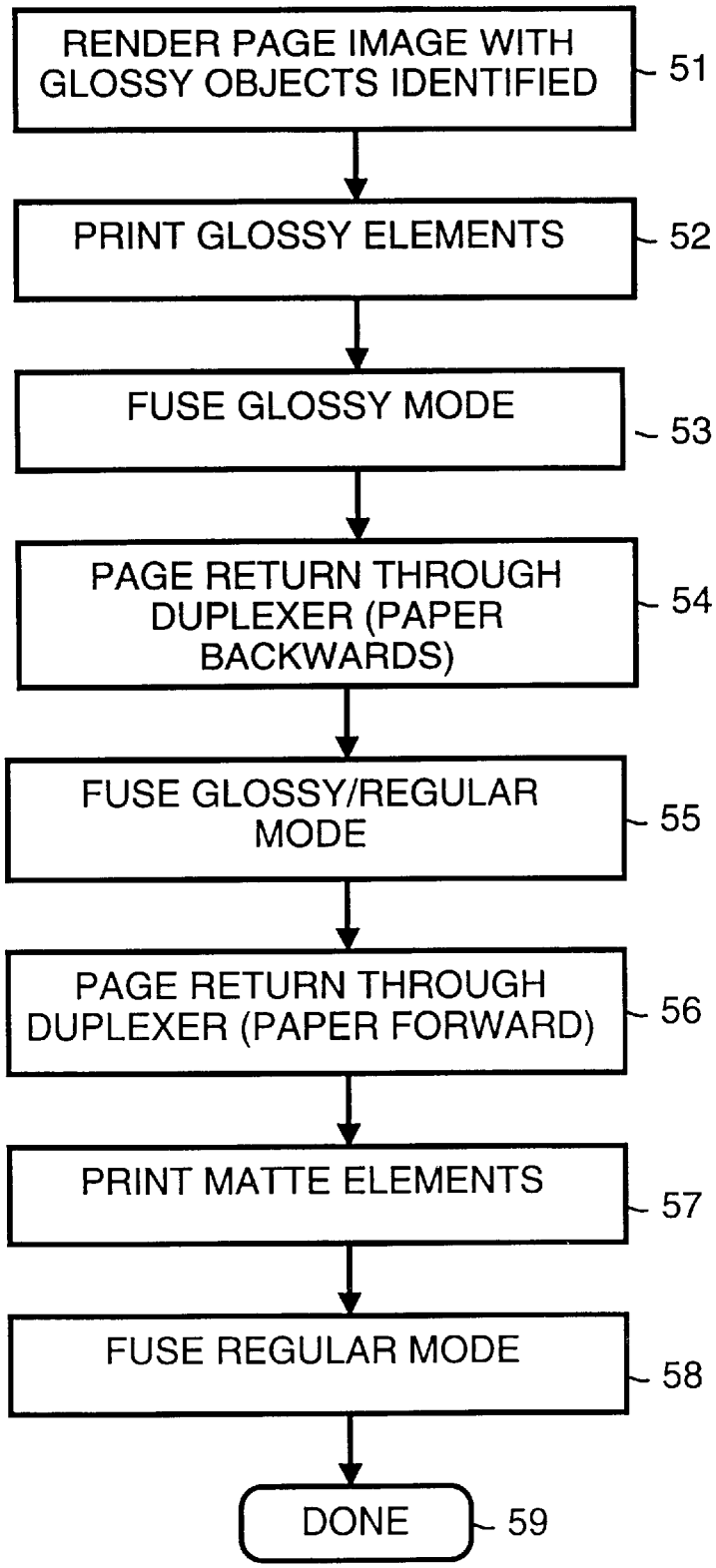
FIG. 1 is a flow chart for a method by which differing gloss levels are utilized for individual elements on a single page in accordance with a preferred embodiment of the present invention.

FIG. 1 is a flowchart of the general process. In a step 51, a page image is rendered with glossy objects identified. The page image can be rendered, for example, by a software driver or by firmware within a printer. The glossy objects are identified, for example, by a user of the computing system using a print color options interface. For example, FIG. 2 shows such a print color options interface.

Figure 2:
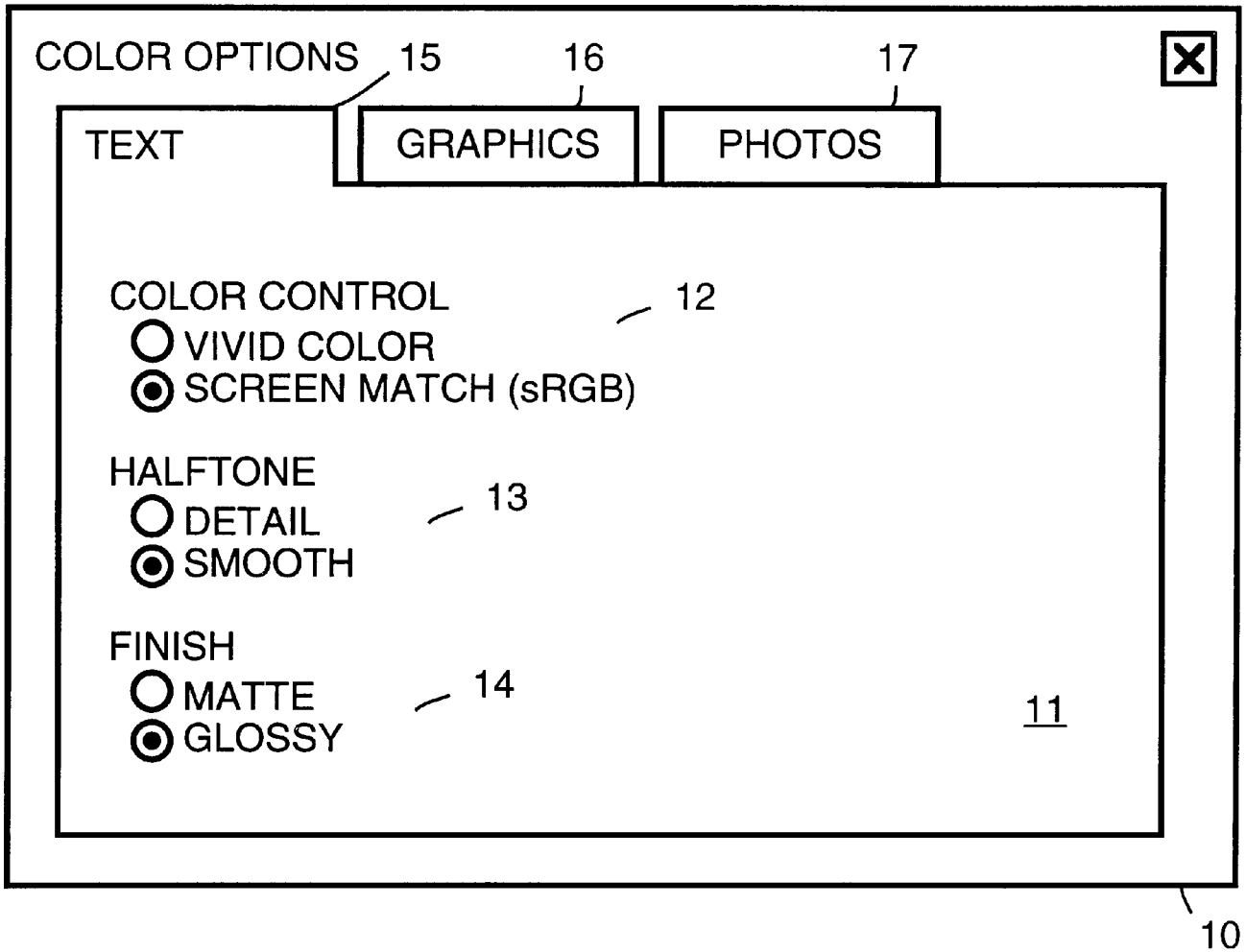
FIG. 2 shows a simplified print color options interface that allows selection of gloss level for individual elements on a single page in accordance with a preferred embodiment of the present invention.

As shown in FIG. 2, a print color options interface 10 allows a user to select different settings for different types of elements within a print job. The print job may include one or several pages. Three different types of elements are identified by print color options interface 10: text, graphics, and photos. Using tabs a user can call up color options for each type of element. Selecting a text tab 15 calls up text color options 11. Selecting a graphics tab 16 calls up graphics color options. Selecting a photo tab 17 calls up photo color options.

As illustrated by text color options 11, a user can make selections using color control options 12, halftone options 13, and finish selections 14. In the embodiment shown in FIG. 2, two options are given for each of color control, halftone, and finish. However, as will be understood by persons of ordinary skill in the art, in alternative embodiments of the present invention more than two options can be given allowing a user to select between several levels.

As shown in FIG. 2, color control options 12 allow a user to select vivid color or a screen match coloring screen. Halftone options 13 allow a user to select printing emphasizing detail or smoothness. Finish options 14 allow a user to select a matte finish or a glossy finish. Alternatively, the type of finish for each element type can be chosen automatically by a computing system.

Figure 3:
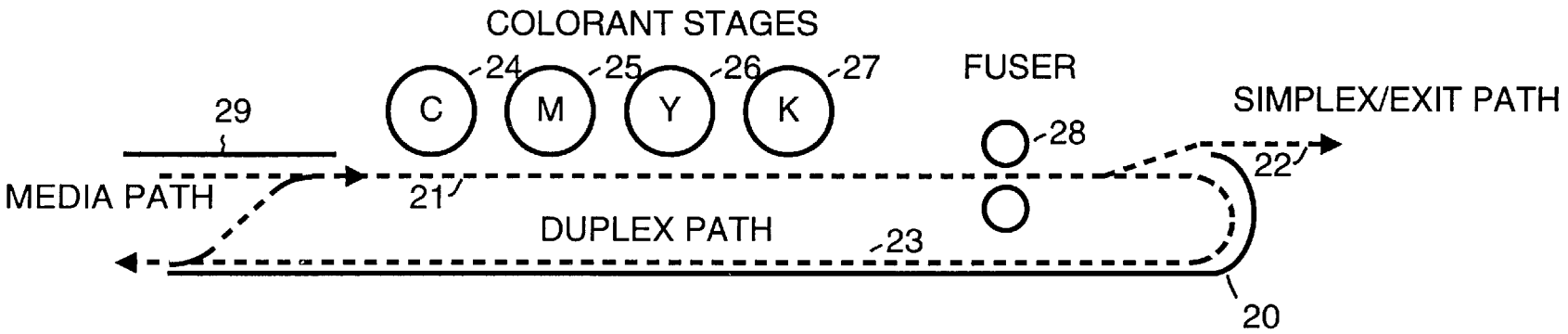
FIG. 3 is a simplified diagram that shows a paper path through a printer that facilitates selection of gloss level for individual elements on a single page in accordance with a preferred embodiment of the present invention.

In a step 52, shown in FIG. 1, glossy elements are printed. Printing is illustrated by FIG. 3. When printing glossy elements, each sheet of media (represented by a sheet of media 29) is fed through a media path 21 of a print engine 20. A cyan (C) colorant stage 24 places cyan colorant on the media. A magenta (M) colorant stage 25 places magenta colorant on the media. A yellow (Y) colorant stage 26 places yellow colorant on the media. A black (K) colorant stage 27 places black colorant on the media. For example, the colorant is toner. Alternatively, the colorant can be wet ink or another form of colorant. Also, a four color (CMYK) scheme is disclosed; however, different color schemes with different numbers of colorants and as well as different colorants can be utilized.

In a step 53, shown in FIG. 1, fusing is performed in glossy mode. This is performed, for example, by a fuser 28 shown in FIG. 3. This step is omitted for printers which do not utilize a fuser.

In a step 54, shown in FIG. 1, a page return through a duplexer is performed. The duplexer is used to flip the sheet of media over and feed the media (backwards) into the printer. This is illustrated in FIG. 3 by a duplex media path 23. At this point, any printing of (glossy or matte) elements on the reverse side of the media can be performed.

In a step 55, shown in FIG. 1, fusing is again performed in glossy or regular mode. This step can be omitted when there are no elements printed on the reverse side and is omitted for printers which do not utilize a fuser.

In a step 56, a page return through the duplexer is again performed. The duplexer is used to flip the sheet of media over and feed the media (forwards) into the printer. This is illustrated in FIG. 3 by duplex media path 23.

In a step 57, shown in FIG. 1, matte elements are printed, for example, using cyan (C) colorant stage 24, magenta (M) colorant stage 25, yellow (Y) colorant stage 26 and black (K) colorant stage 27.

In a step 58, shown in FIG. 1, fusing is again performed, this time in regular mode (for matte finish). This is performed, for example, by fuser 28 shown in FIG. 3. This step is omitted for printers which do not utilize a fuser.

In a step 59, the process is complete, and the media proceeds out of print engine 20 utilizing a simplex/exit path 22. However, in the case where a reverse side of the media includes both glossy and matte elements, an extra trip through the duplexer will be necessary before sending the media out simplex/exit path 22.

Figure 4:
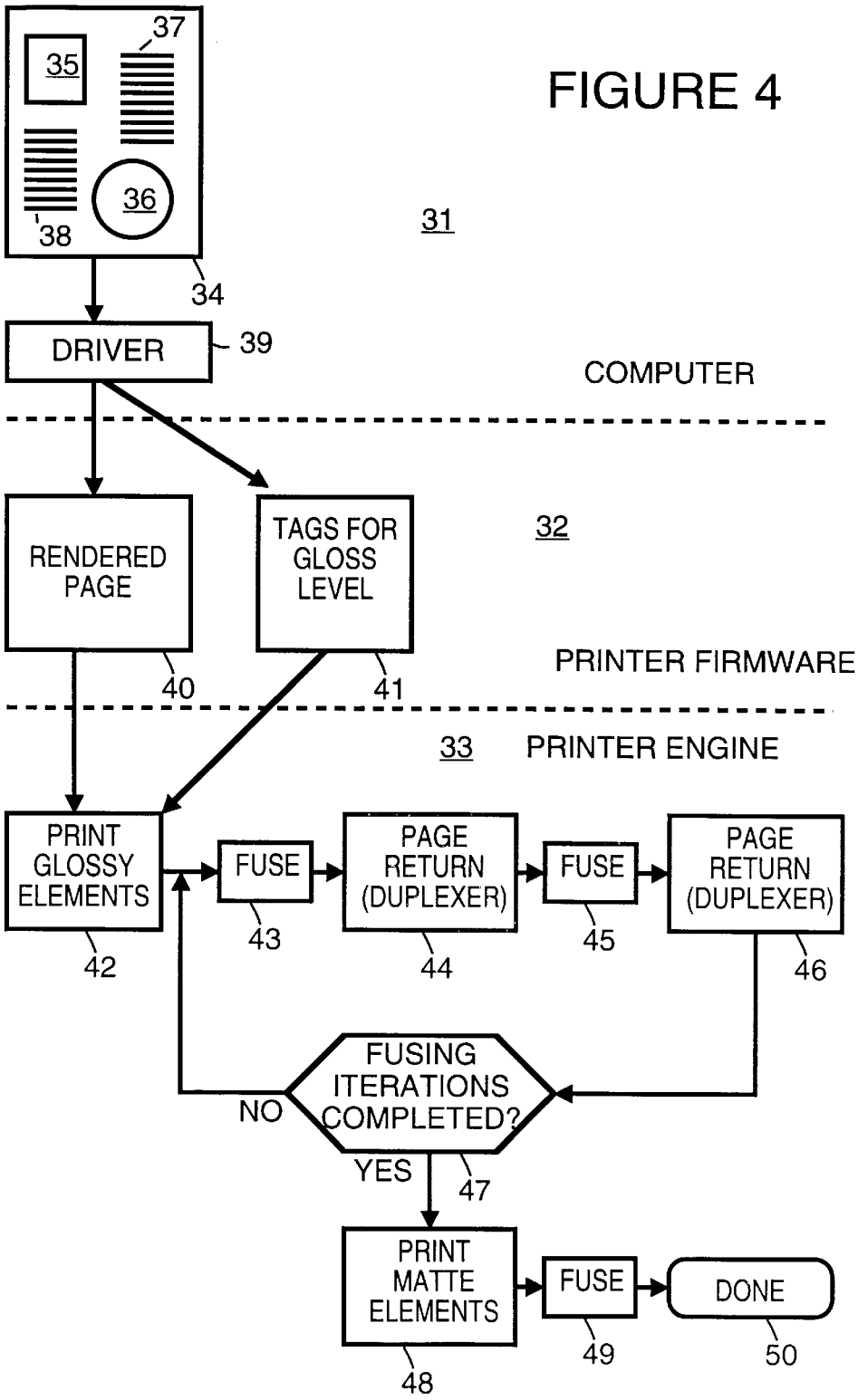
FIG. 4 is a flow chart for a print job in which there are differing gloss levels for individual elements on a single page in accordance with a preferred embodiment of the present invention.

FIG. 4 is a flow chart for an example print job in which there are differing gloss levels for individual elements on a single page. A page 34 residing in memory of a computer 31 includes a photo element 35, a graphic element 36, a text element 37 and a text element 38. A software driver 39 within computer 31 forwards print information to printer firmware 32 within a printer. Print firmware 32 prepares a rendered page 40. Alternatively, rendering can be performed by software driver 39. Printer firmware 32 works as a print controller to control printing. Printer firmware 32 utilizes tags for gloss level 41. Example tags are set out in Table 1 below:

TABLE 1

| | |
|---|---|
| Text = | Matte |
| Graphics = | Matte |
| Photos = | Glossy |

A printer engine 33 utilizes tags for gloss level 41 when printing rendered page 40. In a step 42, printer engine 33 prints the glossy elements. In a step 43 a fuse is performed. In a step 44, a duplexer page return is performed. In a step 45 another fuse can be performed. In a step 47, a check can be made to see if the required number of fusing iterations have been completed. For example, in some embodiments of the present invention the level of glossiness can be varied based on the number of times fusing is performed.

In a step 48, matte elements are printed. In a step 49, fusing is again performed. In a step 50, the process is completed.

Table 2 below sets out pseudo code instructions sent from printer firmware 32 to printer engine 33 to perform both glossy and matte printing on a single side of a media sheet.

TABLE 2

```
begin print process
set glossy fuse mode
send glossy content
    (fuse glossy)
send paper through duplex path
set fuse mode (glossy or matte)
send null content
    (fuse glossy or matte)
send paper through duplex path
set matte fuse mode
send matte content
    (fuse matte)
exit media
```

In cases where both matte and glossy elements are printed on a reverse side of the media, an additional duplex circuit through the print engine is required.

FIG. 5 is a flow chart for an example print job in which there are differing gloss levels for individual elements on a double-sided page. A first page 64 residing in memory of a computer 61 includes a photo element 65, a graphic element 66, a text element 67 and a text element 68. A second page 94 residing in memory of a computer 91 includes a photo element 95, a graphic element 96, a text element 97 and a text element 98. A software driver 69 within computer 61 forwards print information to printer firmware 62 within a printer.

Print firmware 62 prepares a rendered page 70 and a rendered page 100. Alternatively, rendering can be performed by software driver 69. Printer firmware 62 works as a print controller to control printing. Printer firmware 62 utilizes tags for gloss level 71 and tags for gloss level 101. Example tags are set out in Table 3 below:

TABLE 3

| | |
|---|---|
| Text = | Matte |
| Graphics = | Matte |
| Photos = | Glossy |

A printer engine 63 utilizes tags for gloss level 71 when printing rendered page 70 and utilizes tags for gloss level 101 when printing rendered page 100. In a step 72, printer engine 63 prints the glossy elements for page 64 on a first side of the media. In a step 73 a fuse is performed. In a step 74, a duplexer page return is performed. In a step 75, printer engine 63 prints the glossy elements for page 94 on a second side of the media. In a step 76 a fuse is performed. In a step 77, a duplexer page return is performed. In a step 78, a check can be made to see if the required number of fusing iterations have been completed. For example, in some embodiments of the present invention the level of glossiness can be varied based on the number of times fusing is performed. If additional fusing is required, in a step 79, a fuse is performed. In a step 80, a duplexer page return is performed. Then steps 76, 77 and 78 are repeated.

In a step 81, matte elements for page 64 are printed. In a step 82, fusing is performed. In a step 83, a duplexer page return is performed. In a step 84, matte elements for page 94 are printed. In a step 85, fusing is performed. In a step 86, the process is completed.

Table 4 below sets out pseudo code instructions sent from printer firmware 62 to printer engine 63 to perform both glossy and matte printing on both sides of a media sheet.

TABLE 4

```
begin print process
set glossy fuse mode
send glossy content, side 1
    (fuse glossy)
send paper through duplex path
set glossy fuse mode
send glossy content, side 2
    (fuse glossy)
send paper through duplex path
set matte fuse mode
send matte content, side 1
    (fuse matte)
send paper through duplex path
set matte fuse mode
send matte content, side 2
    (fuse matte)
exit media
```

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

I claim:

1. A method for printing comprising the following steps:

(a) feeding a sheet of media into a print engine with a first side of the sheet of media in position to be printed upon;

(b) printing a first element on the first side of the sheet of media with a first gloss level finish;

(c) circulating the sheet of media in a duplex media path so that the sheet of media is again fed into the print engine but with a second side of the sheet of media in position to be printed upon;

(d) circulating the sheet of media in the duplex media path so that the sheet of media is fed into the print engine with the first side of the sheet of media in position to be printed upon; and, (e) printing a second element on the first side of the sheet of media with a second gloss level finish.

2. A method as in claim 1 wherein the first gloss level finish is a higher gloss finish than the second gloss level finish.

3. A method as in claim 1, wherein step (b) includes the following substeps:

(b.1) placing toner on the first side of the sheet of media; and, (b.1) fusing the first side of the sheet of media at a setting corresponding to the first gloss level finish.

4. A method as in claim 3, wherein step (e) includes the following substeps:

(e.1) placing toner on the first side of the sheet of media; and, (e.1) fusing the first side of the sheet of media at a setting corresponding to the second gloss level finish.

5. A method as in claim 1 additionally comprising the following step performed after step (c):

printing a third element on the second side of the sheet of media with the first gloss level finish.

6. A method as in claim 5 additionally comprising the following steps performed after step (e):

circulating the sheet of media in the duplex media path so that the sheet of media is again fed into the print engine with the second side of the sheet of media in position to be printed upon; and, printing a fourth element on the second side of the sheet of media with the second gloss level finish.

7. A method as in claim 1 additionally comprising the following step performed before step (a):

rendering a page image where the first element is identified as having the first gloss level finish and the second element is identified as having the second gloss level finish.

8. A printer comprising:

a print engine, the print engine having a duplex media path that allows printing on both sides of media; and, a print controller, the print controller forwarding instructions to the print engine that instruct the print engine to perform the following tasks:

feed a sheet of media with a first side of the sheet of media in position to be printed upon, print a first element on the first side of the sheet of media with a first gloss level finish, circulate the sheet of media in the duplex media path so that the sheet of media is again fed but with a second side of the sheet of media in position to be printed upon, circulate the sheet of media in the duplex media path so that the sheet of media is again fed with the first side of the sheet of media in position to be printed upon, and print a second element on the first side of the sheet of media with a second gloss level finish.

9. A printer as in claim 8 wherein the first gloss level finish is a higher gloss finish than the second gloss level finish.

10. A printer as in claim 8, wherein the print engine prints the first element on the first side of the sheet of media by placing toner on the first side of the sheet of media, and fusing the first side of the sheet of media at a setting corresponding to the first gloss level finish.

11. A printer as in claim 10, wherein the print engine prints the second element on the first side of the sheet of media by placing toner on the first side of the sheet of media, and fusing the first side of the sheet of media at a setting corresponding to the second gloss level finish.

12. A printer as in claim 8, wherein after instructing the print engine to circulate the sheet of media in the duplex media path so that the sheet of media is again fed but with the second side of the sheet of media in position to be printed upon, the print controller instructs the print engine to print a third element on the second side of the sheet of media with the first gloss level finish.

13. A printer as in claim 12, wherein after instructing the print engine to print the second element on the first side of the sheet of media with a second gloss level finish, the print engine instructs the print engine to perform the following tasks:

circulate the sheet of media in the duplex media path so that the sheet of media is again fed into the print engine with the second side of the sheet of media in position to be printed upon; and, print a fourth element on the second side of the sheet of media with the second gloss level finish.

* * * * *

UNITED STATES PATENT AND TRADEMARK OFFICE

CERTIFICATE OF CORRECTION

PATENT NO. : 6,438,336 B1
DATED : August 20, 2002
INVENTOR(S) : Kurt R. Bengtson It is certified that error appears in the above-identified patent and that said Letters Patent is hereby corrected as shown below:

Column 6,
Line 18, "(b.1)" should read -- (b.2) --;
Line 24, "(e.1)" should read -- (e.2) --.

Signed and Sealed this

Tenth Day of June, 2003

JAMES E. ROGAN
*Director of the United States Patent and Trademark Office*